US006612483B2

(12) United States Patent
Harris et al.

(10) Patent No.: US 6,612,483 B2
(45) Date of Patent: Sep. 2, 2003

(54) DISPLAY BOX

(75) Inventors: Marc Harris, Newton, MA (US); Mark S. Izen, Chestnut Hill, MA (US); Mitchell Myers, Brookline, MA (US); Jonathan Rhodes, Jamaica Plain, MA (US)

(73) Assignee: First Act, Inc., Newton, MA (US)

( * ) Notice: Subject to any disclaimer, the term of this patent is extended or adjusted under 35 U.S.C. 154(b) by 0 days.

(21) Appl. No.: 09/755,272

(22) Filed: Jan. 8, 2001

(65) Prior Publication Data

US 2002/0088848 A1 Jul. 11, 2002

(51) Int. Cl.[7] ..... B65D 5/42

(52) U.S. Cl. ..... 229/104; 206/314; 206/459.5; 229/112; 229/125.19

(58) Field of Search ..... 229/104, 112, 229/120, 125.19; 206/14, 314, 459.5; 248/152, 174

(56) References Cited

U.S. PATENT DOCUMENTS

| | | | | | |
|---|---|---|---|---|---|
| 200,003 | A | * | 2/1878 | Sprowles | 229/112 |
| 1,667,376 | A | * | 4/1928 | Fehrenkamp | 229/104 |
| 1,764,251 | A | * | 6/1930 | Farago | 229/112 |
| 1,797,868 | A | * | 3/1931 | Kelchner | 206/459.5 |
| 2,312,595 | A | * | 3/1943 | Smith | 229/104 |
| 2,331,493 | A | * | 10/1943 | Muhlhauser | 229/112 |
| 2,406,254 | A | * | 8/1946 | Ringler | 229/104 |
| 3,108,569 | A | * | 10/1963 | Kundikoff | 229/120 |
| 3,163,344 | A | * | 12/1964 | Tunick | 229/120 |
| 3,178,242 | A | * | 4/1965 | Ellis et al. | 229/104 |
| 3,532,263 | A | * | 10/1970 | Ross | 229/104 |
| 3,650,383 | A | * | 3/1972 | Nigro | 229/112 |
| 4,030,596 | A | * | 6/1977 | Snyder et al. | 229/104 |
| 4,962,859 | A | * | 10/1990 | Kump | 248/174 |
| 5,402,930 | A | * | 4/1995 | Storms et al. | 229/120 |
| 5,704,193 | A | * | 1/1998 | Roe et al. | 229/120 |
| 5,878,947 | A | * | 3/1999 | Hoy et al. | 229/104 |

* cited by examiner

*Primary Examiner*—Gary E. Elkins
(74) *Attorney, Agent, or Firm*—John E. Toupal; Harold G. Jarcho

(57) ABSTRACT

A display including a box having a top wall, a first side wall joined to the bottom wall along a first edge, a second side wall joined to the bottom wall along a second edge, a third side wall joined to the bottom wall along a third edge and straddled by the first side wall and the second side wall; and a projection projecting outwardly from the third side wall.

8 Claims, 4 Drawing Sheets

DISPLAY BOX

BACKGROUND OF THE INVENTION

The invention relates generally to container boxes and, more particularly, to boxes used to display their merchandise content.

Boxes are widely used to transport, store and protect articles of various size and shape. For some applications, photographs of its contents are applied to outer surfaces of the boxes allowing them to be used as displays in a retail environment. Also, boxes are generally dimensioned according to its contents in the interest of conserving space and material. Accordingly, boxes assume a variety of sizes and shapes depending on the shape and contour of their contents. Some shapes result in boxes with instability which prevents their effective use as displays.

The object of this invention, therefore, is to provide an improved box that can be effectively used for display of its contents.

SUMMARY OF THE INVENTION

The invention is a display including a box having a top wall, a first side wall joined to the bottom wall along a first edge, a second side wall joined to the bottom wall along a second edge, a third side wall joined to the bottom wall along a third edge and straddled by the first side wall and second side wall; and a projection projecting outwardly from the third side wall. The projection supports the box in an upright position desired for display of its contents.

According to one feature of the invention, the projection includes at least one tab projecting from the third edge, and having a perimeter with given dimensions and the third end wall defines an opening directly adjacent to the tab and having a perimeter with the given dimensions. The tab and opening facilitate fabrication of the box from a cardboard blank.

According to another feature of the invention, the tab projects in a direction substantially normal to the third end wall. The normal tab optimizes the position orientation desired for the box.

According to still another feature, the box includes a fourth side wall straddled by the first side wall and the second side wall. The fourth side wall closes the perimeter of the box.

According to further features, the box has an open bottom opposite to the top wall; and the display includes a closure having a bottom wall covering the open bottom and a mating side wall engaging each of the first, second, third and fourth side walls. The closure facilitates use of the box for storage and shipping of its contents.

According to an additional feature, the first and second side walls each have lengths l and L, respectively, substantially greater than a uniform width w of the third side wall. The elongated box is suited for display of similarly shaped articles.

According to an important feature of the invention, the projection includes a pair of tabs spaced apart substantially along the third edges, and the third wall defines a pair of openings, one directly adjacent to each of the tabs and having the same perimeter dimensions thereas. The plural tabs provide the desired support with minimum tab dimensions.

According to a special feature of the invention, the box retains an item of merchandise and the top wall includes a pictorial display of the item. The display identifies its contents with the box supported in a desired display orientation.

The invention also encompasses a method of constructing a box including the step of cutting a blank having a top wall portion, a first side wall portion, a second side wall portion, and a third wall portion straddled by the first and second side wall portions; the third side wall portion being substantially shorter than the first and second side wall portions; scoring first, second, and third lines between the top wall portion and, respectively, the first, second and third side wall portions; forming slits in the blank along the perimeter of at least one tab portion extending into the third side wall portion from the third line; and cutting and shaping outer portions of the first, second and third side wall portions at opposite ends of, respectively, the first, second and third lines. After the first, second and third side wall portions are folded in directions transverse to the top wall portion to separate at least one tab portion from the third side wall portion; and joining outer portions to form its comers, the box can be stably disposed in a desired upright position for display.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
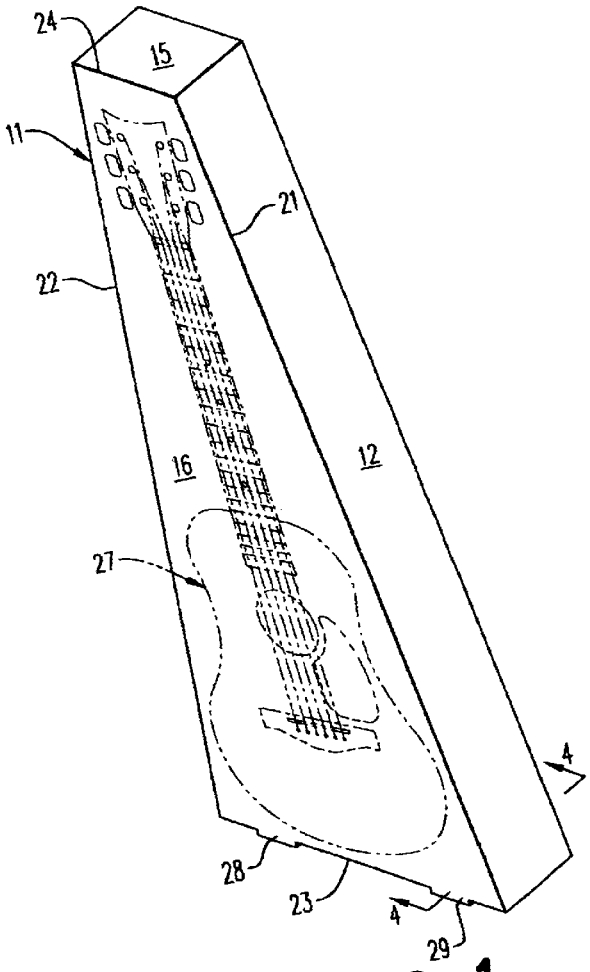
FIG. 1 is a frontal right side perspective of a box according to the invention.
Figure 2:
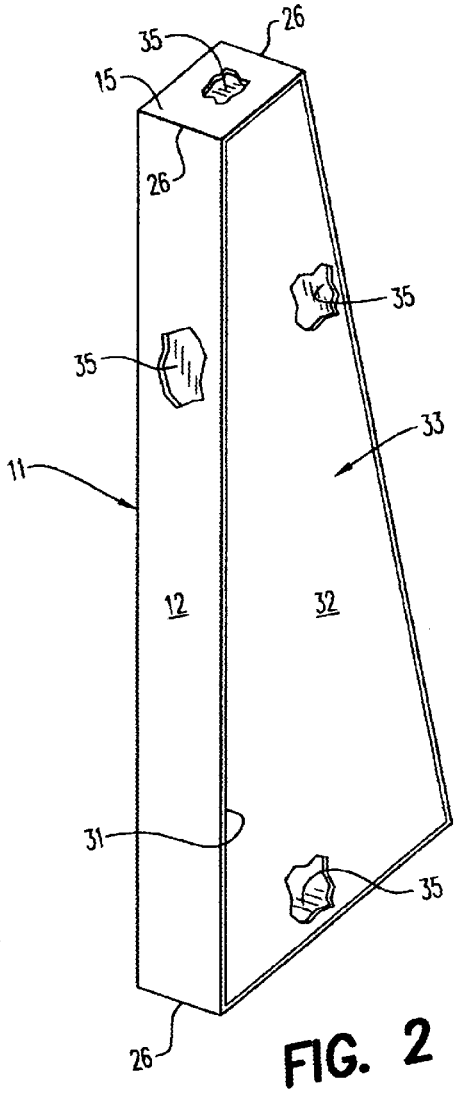
FIG. 2 is a rear left side perspective view of the box.
Figure 5:
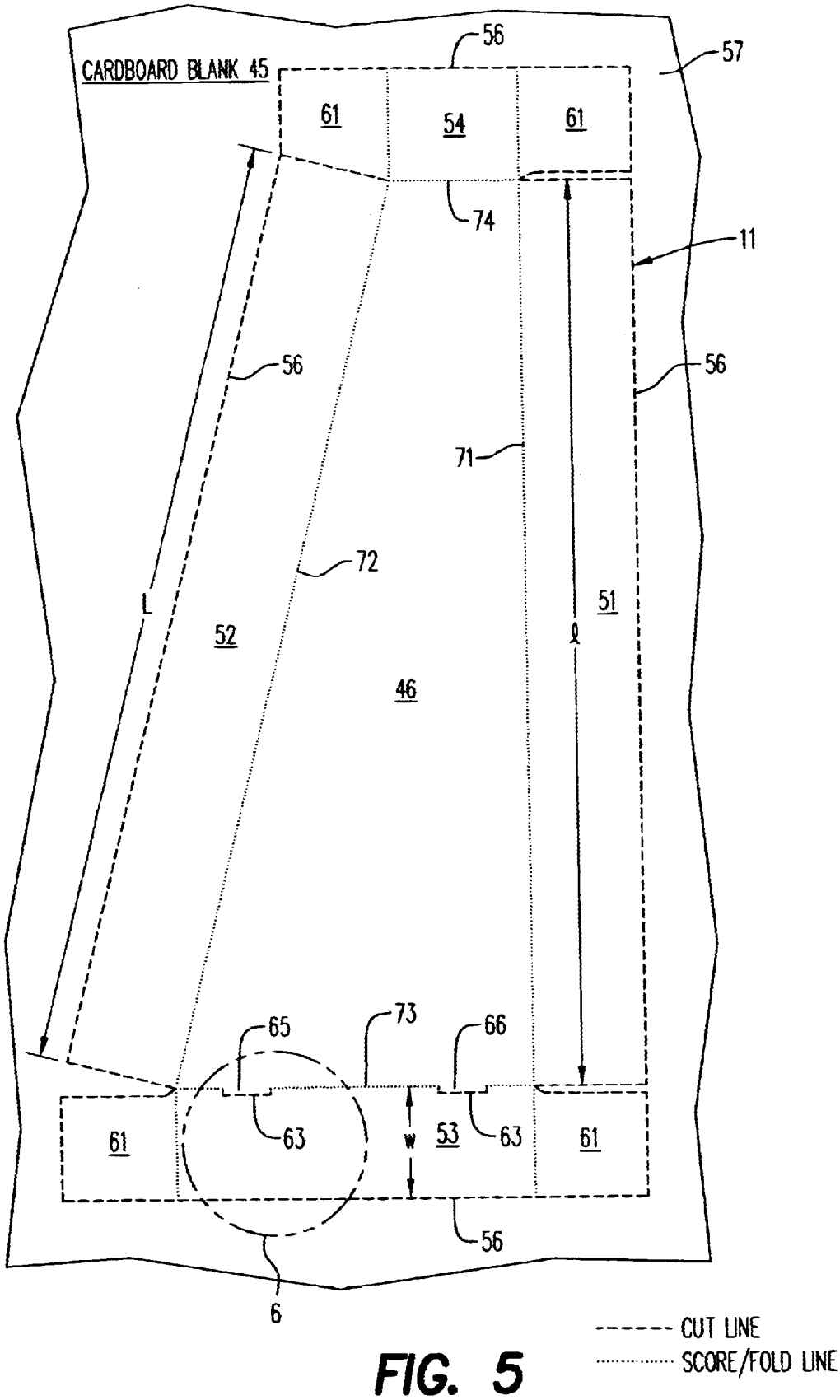
FIG. 5 is a plan view of a cardboard blank used for constructing the box.
Figure 6:
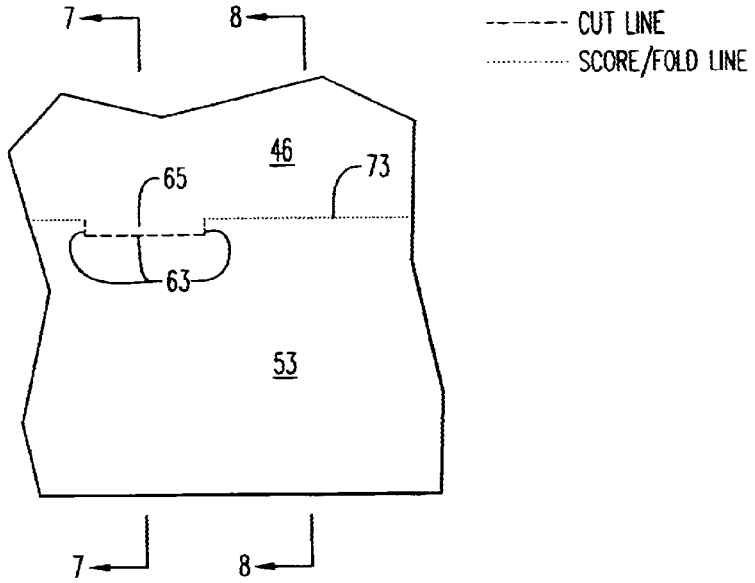
FIG. 6 is a detailed view of a portion 6 of the blank shown in FIG. 5.
Figure 7A:
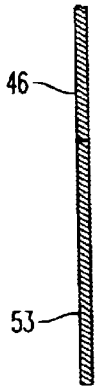
FIGS. 7A–7C are cross sectional views taken along lines 7—7 of FIG. 6 and showing the box in various stages of assembly.
Figure 7B:
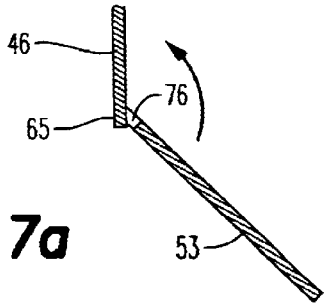
Figure 7C:
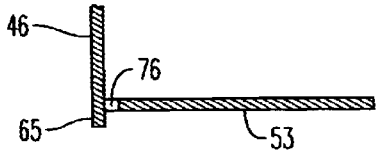
Figure 8A:
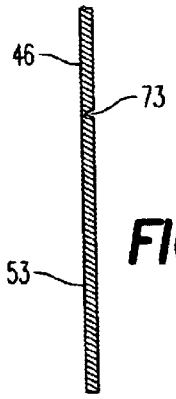
FIGS. 8A–8C are cross sectional views taken along lines 8—8 of FIG. 6 and also showing the box at various stages of assembly.
Figure 8B:
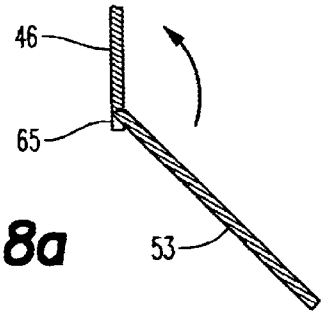
Figure 8C:
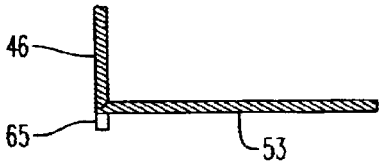

A box 11 has first, second, third and fourth side walls 12–15 projecting transversely from a top wall 16 as shown in FIGS. 1 and 2. The third and fourth side walls 14, 15 each are straddled by the first and second side walls 12, 13. Formed between the first, second, third and fourth side walls 12–15 and the top wall 16 are, respectively, first, second, third and fourth edges 21–24 of the box 11. Comers 26 of the box 11 are formed at intersections of the side walls 12–15. Applied to the outer planar surface of the top wall 16 is a pictorial display of a guitar, the intended content of the box 11. A pair of tabs 28, 29 project from the third edge 23 in a direction normal to the third side wall 14. The tabs 28, 29 are spaced apart a substantial distance along the third edge 23 as shown in FIG. 1. To closely accommodate a retained guitar, the first and second side walls 12, 13 have lengths l, L, respectively, substantially greater than the uniform width w of the third side wall 14 as shown in FIG. 5. Also, the length of the fourth side wall 15 is substantially less than the length of the third side wall 14.

The box 11 has an open bottom 31 which is closed by a bottom wall 32 of a closure 33 as shown in FIG. 2. Projecting transversely from the wall bottom 32 along its edges are mating side walls 35 that project into the box 11 and engage the side walls 12–15 thereof. To access a guitar retained within the box 11, the closure 33 is disengaged from the box 11 to expose its open bottom 31.

Figure 3:
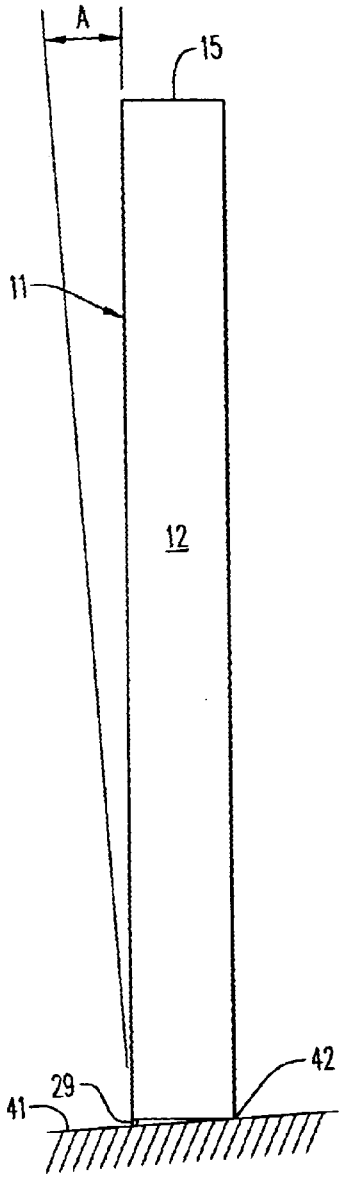
FIG. 3 is a right side view of the box.
Figure 4:
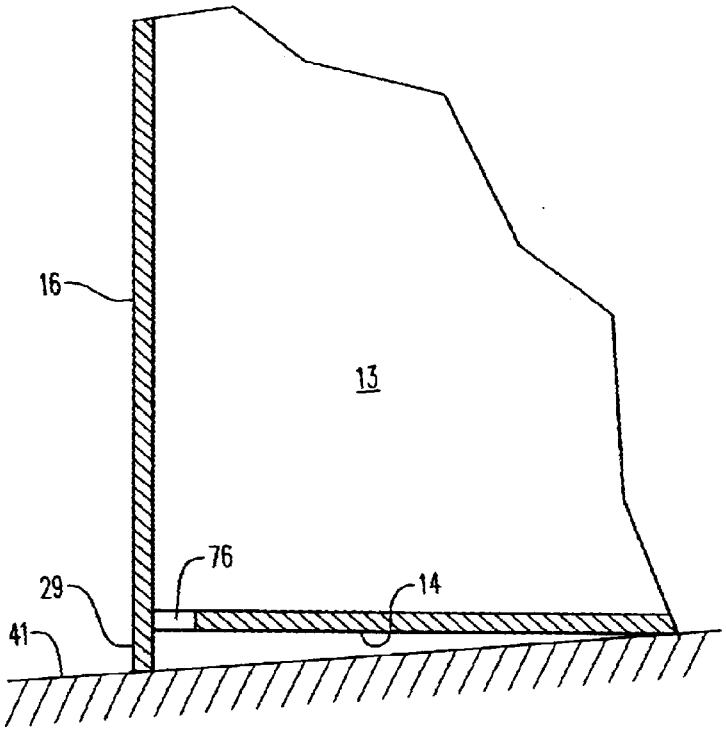
FIG. 4 is a cross sectional view taken along lines 4—4 of FIG. 1.

The engaged box and closure 33 can be positioned in a display area with the box 11 supported on a suitable support surface 41 as shown in FIGS. 3 and 4 Preferably, the box 11 is oriented as shown to present the pictorial display 27 in an upright position. With that orientation, the box 11 is supported adjacent to the third edge 23 by the projecting tabs 28, 29 and an opposite edge 42 of the side wall 14 which edge forms one perimeter portion of the open bottom 31. The engagement of the tabs 28, 29 with the surface 41 produces a shining of the box 11 from the vertical by an angle A and resulting obtuse orientation with respect to the surface 41 (FIG. 3) Because the box 11 does not rest directly on the narrow side.

FIGS. 5–8 schematically illustrate a preferred method for constructing the box 11. A cardboard blank 45 includes a top wall portion 46 and first, second, third and fourth side wall portions 51–54 surrounding top wall portion 46. The blank 45 is cut along dashed lines 56 to separate the top wall portion 46 and side wall portions 51–54 from the blank remnant 57. The cutting process shapes outer end portions 61 of the wall portions 51–54. Also formed in the blank 45 during the cutting process are slits 65 along perimeters of tab portions 65, 66 each having a perimeter with given dimensions and extending into the third side wall portion 53.

The blank 45 also is scored along first, second, third and fourth dotted lines 71–74 extending between the top wall portion 46 and, respectively, the first, second, third and fourth side wall portions 51–54. After separation from the blank 45, the side wall portions 51–54 are folded along the lines 71–74 in directions transverse to the top wall portion 46 to form the first, second, third and fourth side walls 12–15. The folding process results in separation of the tab portions 65, 66 from the side wall portion 53 to thereby form the tabs 28, 29 of FIG. 1. Also formed by the folding process are openings 76 having the same given dimensions as the tab portions 65, 66. Finally, the outer side wall portions 61 are joined to form the comers 26 of the box 11.

Obviously, many modifications and variations of the present invention are possible in light of the above teachings. It is to be understood, therefore, that the invention can be practiced otherwise than as specifically described.

What is claimed is:

1. Display apparatus comprising:

a box having a top wall, a first side wall joined to said top wall along a first edge, a second side wall joined to said bottom wall along a second edge, a third side wall joined to said top wall along a third edge and straddled by said first side wall and said second side wall;

a fourth side wall straddled by said first side wall and said second side wall;

said first, second, third arid fourth side walls defining an open bottom opposite to said top wall, and wherein said box includes a closure comprising a bottom wall covering said open bottom; and a mating side wall engaging each of said first side wall, said second side wall, said third side wail and said fourth side wall; and projection means projecting outwardly from said third side wall and shaped and arranged to support said box on a supporting surface and with said top wall oriented obtusely non-perpendicular thereto;

said projection means comprising at least one tab means projecting from said third edge, and having a perimeter with given dimensions, said third side wall defining an opening directly adjacent to said one tab and having a perimeter with said given dimensions, and said tab means projecting in a direction substantially normal to said third side wall.

2. A display apparatus according to claim 1 wherein said first side wall and said second side wall each have lengths l and L, respectively, substantially greater than a uniform width w of said third side wall.

3. A display apparatus according to claim 2 wherein each of said lengths l and L is substantially greater than the length of said third side wall.

4. A display apparatus according to claim 1 wherein said box retains an item of merchandise and at least one of said top wall and said bottom wall includes a display of said item.

5. A display apparatus according to claim 1 wherein said fourth side wall has a length substantially less than the length of said third side wall.

6. A display apparatus according to claim 1 wherein said projection means comprises a pair of tabs spaced apart substantially along said third edge, and said third side wall defines a pair of said openings, one directly adjacent to each of said tabs and having the same perimeter dimensions thereas.

7. A display apparatus according to claim 6 wherein said fourth side wall has a length substantially less than the length of said third side wall.

8. A display apparatus according to claim 1 wherein said box retains an item of merchandise, and said top wall includes display of said item.

* * * * *